US011211004B1

(12) United States Patent
Kim et al.

(10) Patent No.: US 11,211,004 B1
(45) Date of Patent: Dec. 28, 2021

(54) PIXEL AND DISPLAY APPARATUS

(71) Applicant: Samsung Display Co., Ltd., Yongin-si (KR)

(72) Inventors: Keunwoo Kim, Yongin-si (KR); Taewook Kang, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/155,925

(22) Filed: Jan. 22, 2021

(30) Foreign Application Priority Data

Jun. 26, 2020 (KR) ..... 10-2020-0078812

(51) Int. Cl.
*G09G 3/3241* (2016.01)
*G09G 3/3266* (2016.01)
*G09G 3/3291* (2016.01)

(52) U.S. Cl.
CPC ..... *G09G 3/3241* (2013.01); *G09G 3/3266* (2013.01); *G09G 3/3291* (2013.01)

(58) Field of Classification Search
CPC ... G09G 3/3291; G09G 3/3233; G09G 3/3258
USPC ..... 345/76
See application file for complete search history.

(56) References Cited

U.S. PATENT DOCUMENTS 8,441,421 B2 5/2013 Han et al.
8,547,372 B2 10/2013 Chung et al.
9,007,283 B2 4/2015 Choi
10,380,940 B2 8/2019 Lee et al.
2011/0157144 A1* 6/2011 Park ..... G09G 3/3233 345/212
2016/0372037 A1* 12/2016 Lim ..... H01L 27/3276
2017/0053591 A1* 2/2017 Seo ..... G09G 3/3225
2017/0148384 A1* 5/2017 Lee ..... G09G 3/3233

FOREIGN PATENT DOCUMENTS

KR 10-1097325 12/2011
KR 10-1682690 12/2016
KR 10-1682691 12/2016
KR 10-2017-0060220 6/2017

* cited by examiner

*Primary Examiner* — Koosha Sharifi-Tafreshi
(74) *Attorney, Agent, or Firm* — Kile Park Reed & Houtteman PLLC

(57) ABSTRACT

A pixel includes a light-emitting element, a driving transistor that controls an amount of a driving current flowing to the light-emitting element according to a gate-source voltage, first and second compensation transistors that operate in response to a first scan signal and are electrically connected in series with each other between a gate and a drain of the driving transistor, first and second gate initialization transistors that operate in response to a second scan signal and are electrically connected in series with each other between a voltage line and the gate of the driving transistor, and a node connection transistor that connects a first floating node and a second floating node to each other in response to the second scan signal. The first floating node is between the first and second compensation transistors, and the second floating node is between the first and second gate initialization transistors.

20 Claims, 6 Drawing Sheets

PIXEL AND DISPLAY APPARATUS

CROSS-REFERENCE TO RELATED APPLICATION(S)

This application claims priority to and benefits of Korean Patent Application No. 10-2020-0078812 under 35 U.S.C. § 119, filed in the Korean Intellectual Property Office on Jun. 26, 2020, the entire contents of which are incorporated herein by reference.

BACKGROUND

1. Technical Field

One or more embodiments relate to a pixel and a display apparatus.

2. Description of the Related Art

An organic light-emitting display apparatus may include a light-emitting element, for example, an organic light-emitting diode, having a luminance that varies with an electric current. A pixel of the organic-light emitting display apparatus may include a light-emitting element, a driving transistor that controls an amount of current supplied to the light-emitting element according to a voltage between a gate and a source of the driving transistor, and a switching transistor that transmits a data voltage for controlling the luminance of the light-emitting element to the driving transistor.

In order to keep the luminance of the light-emitting element constant during one frame, the voltage between the gate and the source of the driving transistor should be kept constant. To this end, a pixel may further include a storage capacitor electrically connected to the gate of the driving transistor.

In order to display more vivid images, the resolution of the organic light-emitting display apparatus has been gradually increased, and the size of the pixel has been gradually decreased. The volume of the storage capacitor has also been decreased to reduce the size of the pixel. Accordingly, a gate voltage of the driving transistor may be changed even by a small amount of leakage current, which results in a change in the luminance of the light-emitting element.

Moreover, in order to reduce power consumption of the organic light-emitting display apparatus or an electronic device electrically connected thereto, a technology of driving at a low frame rate according to circumstances has been used. A frame period may be further increased, and thus a change in the luminance of the light-emitting element may be better recognized by a user.

It is to be understood that this background of the technology section is, in part, intended to provide useful background for understanding the technology. However, this background of the technology section may also include ideas, concepts, or recognitions that were not part of what was known or appreciated by those skilled in the pertinent art prior to a corresponding effective filing date of the subject matter disclosed herein.

SUMMARY

One or more embodiments may provide a pixel capable of reducing a turn-off current of a switching transistor electrically connected to a storage capacitor, and a display apparatus including the same.

The technical objectives to be achieved by the disclosure are not limited to the above-described objectives, and other technical objectives that are not mentioned herein would be clearly understood by a person skilled in the art from the description of the disclosure.

According to one or more embodiments, a pixel may include a light-emitting element, a driving transistor that controls an amount of a driving current flowing to the light-emitting element according to a gate-source voltage, a storage capacitor electrically connected to a gate of the driving transistor, a scan transistor that transmits a data voltage to a source of the driving transistor in response to a first scan signal, first and second compensation transistors that operate in response to the first scan signal, the first and second compensation transistors being electrically connected in series with each other between the gate and a drain of the driving transistor, first and second gate initialization transistors that operate in response to a second scan signal, the first and second gate initialization transistors being electrically connected in series with each other between a voltage line and the gate of the driving transistor, the voltage line transmitting an initialization voltage, and a node connection transistor that connects a first floating node and a second floating node to each other in response to the second scan signal, the first floating node being between the first and second compensation transistors, and the second floating node being between the first and second gate initialization transistors.

The node connection transistor may be turned off in response to a rising edge of the second scan signal, the first and second compensation transistors may be turned off in response to a rising edge of the first scan signal, and the first floating node may be coupled to the rising edge of the second scan signal at a point of time that the node connection transistor is turned off so that a potential of the first floating node increases, and may be coupled to the rising edge of the first scan signal at a point of time that the first and second compensation transistors are turned off so that the potential of the first floating node increases.

The first and second gate initialization transistors may be turned off in response to the rising edge of the second scan signal, and the second floating node may be coupled to the rising edge of the second scan signal at a point of time that the first and second gate initialization transistors are turned off so that a potential of the second floating node increases.

An increase amount in the potential of the first floating node due to coupling with the rising edge of the first scan signal at the point of time that the first and second compensation transistors are turned off may be less than an increase amount in the potential of the second floating node due to coupling with the rising edge of the second scan signal at the point of time that the first and second gate initialization transistors are turned off.

In case that both the node connection transistor and the first compensation transistor are turned off, a turn-off current flowing from the first floating node to the second floating node through the node connection transistor may be greater than a turn-off current flowing from the first floating node to the gate of the driving transistor through the first compensation transistor.

Within one frame period, after the first and second gate initialization transistors and the node connection transistor are turned on in response to the second scan signal having a pulse voltage of a turn-on level, the scan transistor and the first and second compensation transistors may be turned on in response to the first scan signal having a pulse voltage of a turn-on level.

The pixel may further comprise an anode initialization transistor that may apply the initialization voltage to an anode of the light-emitting element in response to a third scan signal.

The third scan signal may be synchronized with the first scan signal.

The pixel may further include a first emission control transistor that connects a power line to the source of the driving transistor in response to an emission control signal, the power line transmitting a driving voltage, and a second emission control transistor that connects the drain of the driving transistor to the anode of the light-emitting element in response to the emission control signal.

The storage capacitor may be electrically connected between the power line and the gate of the driving transistor.

The pixel may further include a third compensation transistor that connects the gate of the driving transistor to the first compensation transistor in response to the first scan signal.

The pixel may further include a third compensation transistor that connects the second compensation transistor to the drain of the driving transistor in response to the first scan signal.

According to one or more embodiments, a pixel may be electrically connected to first to third scan lines respectively transmitting first to third scan signals, an emission control line transmitting an emission control signal, a data line transmitting a data voltage, a power line transmitting a driving voltage, and a voltage line transmitting an initialization voltage. The pixel may include a light-emitting element including an anode and a cathode, a storage capacitor including a first electrode and a second electrode, the first electrode being electrically connected to the power line, and a first transistor including a gate electrically connected to the second electrode of the storage capacitor, a source electrically connected to the power line, and a drain. The pixel may include a second transistor including a gate electrically connected to the first scan line, a source electrically connected to the data line, and a drain electrically connected to the source of the first transistor, a third transistor including a first compensation transistor including a gate electrically connected to the first scan line, a source electrically connected to a first floating node, and a drain electrically connected to the gate of the first transistor, and a second compensation transistor including a gate electrically connected to the first scan line, a source electrically connected to the drain of the first transistor, and a drain electrically connected to the first floating node. The pixel may include a fourth transistor including a first anode initialization transistor including a gate electrically connected to the second scan line, a source electrically connected to the gate of the first transistor, and a drain electrically connected to the second floating node, and a second anode initialization transistor including a gate electrically connected to the second scan line, a source electrically connected to the second floating node, and a drain electrically connected to the voltage line. The pixel may include a fifth transistor including a gate electrically connected to the emission control line, a source electrically connected to the power line, and a drain electrically connected to the source of the first transistor, a sixth transistor including a gate electrically connected to the emission control line, a source electrically connected to the drain of the first transistor, and a drain electrically connected to the anode of the light-emitting element, a seventh transistor including a gate electrically connected to the third scan line, a source electrically connected to the anode of the light-emitting element, and a drain electrically connected to the voltage line, and an eighth transistor including a gate electrically connected to the second scan line, a source electrically connected to the first floating node, and a drain electrically connected to the second floating node.

The eighth transistor may be turned off in response to a rising edge of the second scan signal, the first and second compensation transistors may be turned off in response to a rising edge of the first scan signal, and the first floating node may be coupled to the rising edge of the second scan signal at a point of time that the eighth transistor is turned off so that a potential of the first floating node increases, and may be coupled to the rising edge of the first scan signal at a point of time that the first and second compensation transistors are turned off so that the potential of the first floating node increases.

The first and second gate initialization transistors may be turned off in response to the rising edge of the second scan signal, and the second floating node may be coupled to the rising edge of the second scan signal at a point of time that the first and second gate initialization transistors are turned off so that a potential of the second floating node increases.

An increase amount in the potential of the first floating node due to coupling with the rising edge of the first scan signal at the point of time that the first and second compensation transistors are turned off may be less than an increase amount in the potential of the second floating node due to coupling with the rising edge of the second scan signal at the point of time that the first and second gate initialization transistors are turned off.

In case that both the eighth transistor and the first compensation transistor are turned off, a turn-off current flowing from the first floating node to the second floating node through the eighth transistor may be greater than a turn-off current flowing from the first floating node to the gate of the first transistor through the first compensation transistor.

According to one or more embodiments, a display apparatus may include a substrate extending in a first direction and a second direction, first and second scan lines respectively transmitting first and second scan signals, the first and second scan lines extending in the first direction, a data line transmitting a data voltage, the data line extending in the second direction, a power line transmitting a driving voltage, a voltage line transmitting an initialization voltage, the voltage line extending in the first direction, and pixels arranged on the substrate in the first direction and the second direction. Each of the pixels may include a light-emitting element, a driving transistor that controls an amount of a driving current flowing from the power line to the light-emitting element according to a gate-source voltage, a storage capacitor electrically connected to a gate of the driving transistor, a scan transistor that transmits the data voltage to a source of the driving transistor in response to the first scan signal, first and second compensation transistors that operate in response to the first scan signal, the first and second compensation transistors being electrically connected in series with each other between the gate and a drain of the driving transistor, first and second gate initialization transistors that operate in response to the second scan signal, the first and second gate initialization transistors being electrically connected in series with each other between the gate of the driving transistor and the voltage line, and a node connection transistor that connects a first floating node to a second floating node in response to the second scan signal, the first floating node being between the first and second compensation transistors, and the second floating node being between the first and second gate initialization transistors.

The first floating node may be coupled to a rising edge of the second scan signal at a point of time that the node connection transistor is turned off so that a potential of the first floating node increases by a first level, and may be coupled to a rising edge of the first scan signal at a point of time that the first and second compensation transistors are turned off so that the potential of the first floating node increases by a second level, and the second floating node may be coupled to the rising edge of the second scan signal at a point of time that the first and second gate initialization transistors are turned off so that a potential of the second floating node increases by a third level that is greater than the second level.

In case that both the node connection transistor and the first compensation transistor are turned off, a turn-off current flowing from the first floating node to the second floating node through the node connection transistor may be greater than a turn-off current flowing from the first floating node to the gate of the driving transistor through the first compensation transistor.

Other aspects, features, and advantages other than those described above will become apparent from the following detailed description, claims and drawings for carrying out the disclosure.

BRIEF DESCRIPTION OF THE DRAWINGS

The above and other aspects, features, and advantages of certain embodiments will be more apparent from the following description taken in conjunction with the accompanying drawings, in which.

DETAILED DESCRIPTION OF THE EMBODIMENTS

Figure 1:
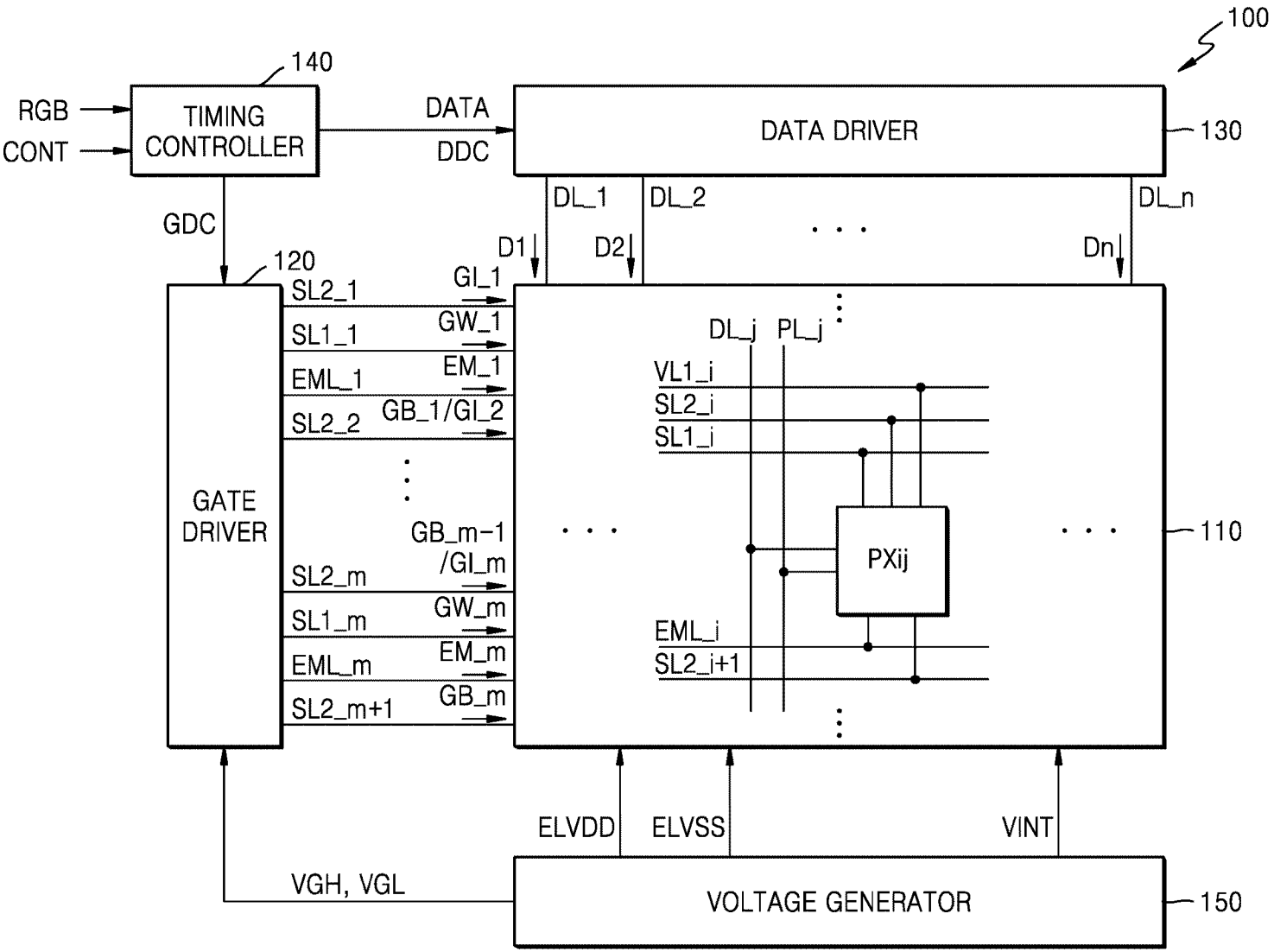
FIG. 1 is a schematic block diagram of an organic light-emitting display apparatus according to an embodiment.

Reference will now be made in detail to embodiments, examples of which are illustrated in the accompanying drawings, wherein like reference numerals refer to like elements throughout. In this regard, the embodiments may have different forms and should not be construed as being limited to the descriptions set forth herein. Accordingly, the embodiments are merely described below, by referring to the figures, to explain aspects of the description.

As used herein, the term "and/or" includes any and all combinations of one or more of the associated listed items. The terms "and" and "or" may be used in the conjunctive or disjunctive sense and may be understood to be equivalent to "and/or." Throughout the disclosure, the expression "at least one of a, b, and c" indicates only a, only b, only c, both a and b, both a and c, both b and c, all of a, b, and c, or variations thereof.

As the disclosure allows for various changes and numerous embodiments, particular embodiments will be illustrated in the drawings and described in detail in the detailed description. Effects and features of the disclosure, and methods for achieving them will be clarified with reference to embodiments described below in detail with reference to the drawings. However, the disclosure is not limited to the following embodiments and may be embodied in various forms.

To clearly describe the embodiments, irrelevant portions of the description are omitted, and in the description with reference to the drawings, the same or corresponding elements are indicated by the same reference numerals and redundant descriptions thereof are omitted.

Although the terms "first," "second," etc. may be used herein to describe various elements, these elements should not be limited by these terms. These elements are only used to distinguish one element from another. In the following embodiments, the singular forms "a," "an," and "the" are intended to include the plural forms as well, unless the context clearly indicates otherwise. It will be understood that when an element is referred to as being "connected" to another element, it may be "directly connected" to another element or "indirectly connected" to another element with intervening elements therebetween. Also, it will be understood that when a unit is referred to as "comprising", "having", "including", or the like with respect to another element, it may not exclude another element but may further include another element unless specifically oppositely indicated.

FIG. 1 is a schematic block diagram of an organic light-emitting display apparatus 100 according to an embodiment.

Referring to FIG. 1, the organic light-emitting display apparatus 100 may include a display part 110, a gate driver 120, a data driver 130, a timing controller 140, and a voltage generator 150.

The display part 110 may include pixels PX such as a pixel PXij located in an $i^{th}$ row and a $j^{th}$ column. For ease of understanding, only one pixel PXij is illustrated in FIG. 1, but m×n pixels PX may be arranged in a matrix form, for example. Here, i may be a natural number of 1 or more and m or less, and j may be a natural number of 1 or more and n or less.

The pixels PX may be electrically connected to first scan lines SL1_1 to SL1_*m*, second scan lines SL2_1 to SL2_*m*+1, emission control lines EML_1 to EML_m, and data lines DL_1 to DL_n. The pixels PX may be electrically connected to power lines (e.g., PL_i) and voltage lines (e.g., VL1_*i*). For example, as illustrated in FIG. 1, the pixel PXij may be electrically connected to the first scan line SL1_*i*, the second scan line SL2_*i*, the emission control line EML_i, the data line DLJ, the power line PL_j, the voltage line VL_i, and the second scan line SL2_*i*+1. The second scan line SL2_*i*+1 may be referred to as a third scan line with respect to the pixel PXij.

The first scan lines SL1_1 to SL1_*m*, the second scan lines SL2_1 to SL2_*m*+1, the emission control lines EML_1 to EML_m, and the voltage lines may extend in a first direction (e.g., a row direction) and be electrically connected to pixels PX located in the same row. The data lines DL_1 to DL_n and the power lines may extend in a second direction (e.g., a column direction) and be electrically connected to pixels PX located in the same column.

The first scan lines SL1_1 to SL1_*m* may transmit first scan signals GW_1 to GW_m output from the gate driver 120 to the pixels PX in the same row, the second scan lines SL2_1 to SL2_*m* transmit second scan signals GI_1 to GI_m output from the gate driver 120 to the pixels PX in the same row, and the second scan lines SL2_2 to SL2_*m*+1 transmit third scan signals GB_1 to GB_m output from the gate driver 120 to the pixels PX in the same row, respectively. Both the second scan signal GI_m and the third scan signal GB_$m$−1 may be transmitted through the second scan line SL2_$i$, and may actually be the same signal.

The emission control lines EML_1 to EML_m may transmit emission control signals EM_1 to EM_m output from the gate driver 120 to the pixels PX in the same row, respectively. The data lines DL_1 to DL_n may transmit data voltages D1 to Dm output from the data driver 130 to the pixels PX in the same column, respectively. The pixel PXij may receive the first to third scan signals GW_i, GI_i, and GB_i, a data voltage Dj, and the emission control signal EM_i (see, e.g., FIG. 2).

The power lines may transmit a first driving voltage ELVDD output from the voltage generator 150 to the pixels PX in the same column, respectively. The voltage lines may transmit an initialization voltage VINT output from the voltage generator 150 to the pixels PX in the same row.

The pixel PXij may include a light-emitting element and a driving thin-film transistor (TFT) that controls an amount of a driving current flowing to the light-emitting element based on the data voltage Dj. The data voltage Dj may be output from the data driver 130 and may be received by the pixel PXij through the data line DL_j. The light-emitting element may be, for example, an organic light-emitting diode. Because the light-emitting element may emit light with a brightness corresponding to an amount of a driving current received from the driving TFT, the pixel PXij may express a gray scale corresponding to the data voltage Dj.

A pixel PX may correspond to a portion of a unit pixel capable of displaying full color, for example, a sub-pixel. The pixel PXij may further include at least one switching TFT and at least one capacitor. The pixel PXij will be described in more detail with reference to FIGS. 2 and 3.

The voltage generator 150 may generate voltages necessary for driving the pixel PXij. For example, the voltage generator 150 may generate the first driving voltage ELVDD, a second driving voltage ELVSS, and an initialization voltage VINT. A level of the first driving voltage ELVDD may be higher than a level of the second driving voltage ELVSS. A level of the initialization voltage VINT may be higher than the level of the second driving voltage ELVSS. A level difference between the initialization voltage VINT and the second driving voltage ELVSS may be less than a threshold voltage required for a light-emitting element of the pixel PX to emit light.

Although not shown in FIG. 1, the voltage generator 150 may generate a first gate voltage (VGH) and a second gate voltage (VGL) for controlling a switching transistor of the pixel PXij and provide the generated first gate voltage (VGH) and the second gate voltage (VGL) to the gate driver 120. In case that the first gate voltage (VGH) is applied to a gate of the switching transistor, the switching transistor may be turned off, and in case that the second gate voltage (VGL) is applied to the gate of the switching transistor, the switching transistor may be turned on. The first gate voltage (VGH) may be referred to as a gate-off voltage, and the second gate voltage (VGL) may be referred to as a gate-on voltage. Switching transistors of the pixel PXij may be p-type metal oxide semiconductor field effect transistors (MOSFETs), and a level of the first gate voltage (VGH) may be higher than a level of the second gate voltage (VGL). Although not shown in FIG. 1, the voltage generator 150 may generate gamma reference voltages and provide them to the data driver 130.

The timing controller 140 may control the display part 110 by controlling operation timings of the gate driver 120 and the data driver 130. The pixels PX of the display part 110 may receive new data voltages D1 to Dn for each frame period and emit light with a luminance corresponding to the data voltages D1 to Dn, thereby displaying an image corresponding to image source data RGB of one frame.

According to an embodiment, one frame period may include a gate initialization period, a data writing and anode initialization period, and a light emission period. During the initialization period, the initialization voltage VINT may be applied to the pixels PX in synchronization with a second scan signal GI. During the data writing and anode initialization period, the data voltages D1 to Dn may be provided to the pixels PX in synchronization with a first scan signal GW, and the initialization voltage VINT may be applied to the pixels PX in synchronization with a third scan signal GB. During the light emission period, the pixels PX of the display part 110 may emit light.

The timing controller 140 may receive the image source data RGB and a control signal CONT from the outside. The timing controller 140 may convert the image source data RGB into image data DATA based on the characteristics of the display part 110 and the pixels PX. The timing controller 140 may provide the image data DATA to the data driver 130.

The control signal CONT may include at least one of a vertical synchronization signal Vsync, a horizontal synchronization signal Hsync, a data enable signal DE, and a clock signal CLK. The timing controller 140 may control operation timings of the gate driver 120 and the data driver 130 by using the control signal CONT.

The timing controller 140 may determine a frame period by counting the data enable signal DE of one horizontal scanning period 1H. The vertical synchronization signal Vsync and the horizontal synchronization signal Hsync supplied from the outside may be omitted. The image source data RGB may include luminance information of the pixels PX. Luminance may have a certain number, for example, 1024 (=210), 256 (=28), or 64 (=26) gray scales.

The timing controller 140 may generate control signals including a gate timing control signal GDC for controlling the operation timing of the gate driver 120 and a data timing control signal DDC for controlling the operation timing of the data driver 130.

The gate timing control signal GDC may include a gate start pulse GSP, a gate shift clock GSC, a gate output enable signal GOE, and the like. The gate start pulse GSP may be supplied to the gate driver 120 that generates a first scan signal at the start of a scan period. The gate shift clock GSC may be a clock signal commonly input to the gate driver 120 and may be a clock signal for shifting the gate start pulse GSP. The gate output enable signal GOE may control the output of the gate driver 120.

The data timing control signal DDC may include a source start pulse SSP, a source sampling clock SSC, a source output enable signal SOE, and the like. The source start pulse SSP may control a data sampling start point of the data driver 130 and may be provided to the data driver 130 at the start of a scan period. The source sampling clock SSC may be a clock signal that controls a sampling operation of data in the data driver 130 based on a rising or falling edge. The source output enable signal SOE may control the output of the data driver 130. The source start pulse SSP supplied to the data driver 130 may be omitted depending on a data transmission method.

The gate driver 120 may sequentially generate the first scan signals GW_1 to GW_m, the second scan signals GI_1 to GI_m, and the third scan signals GB_1 to GB_m in response to the gate timing control signal GDC supplied from the timing controller 140 by using the first and second gate voltages VGH and VGL provided from the voltage generator 150.

The data driver 130 may sample and latch the image data DATA supplied from the timing controller 140 in response to the data timing control signal DDC supplied from the timing controller 140 and convert the image data DATA into data in a parallel data system. In case converting the data in the parallel data system, the data driver 130 may convert the image data DATA into a gamma reference voltage and convert the gamma reference voltage into an analog data voltage. The data driver 130 provides data voltages D1 to Dn to the pixels PX through the data lines DL_1 to DL_n. The pixels PX may receive the data voltages D1 to Dn in response to the first scan signals GW_1 to GW_m.

Figure 2:
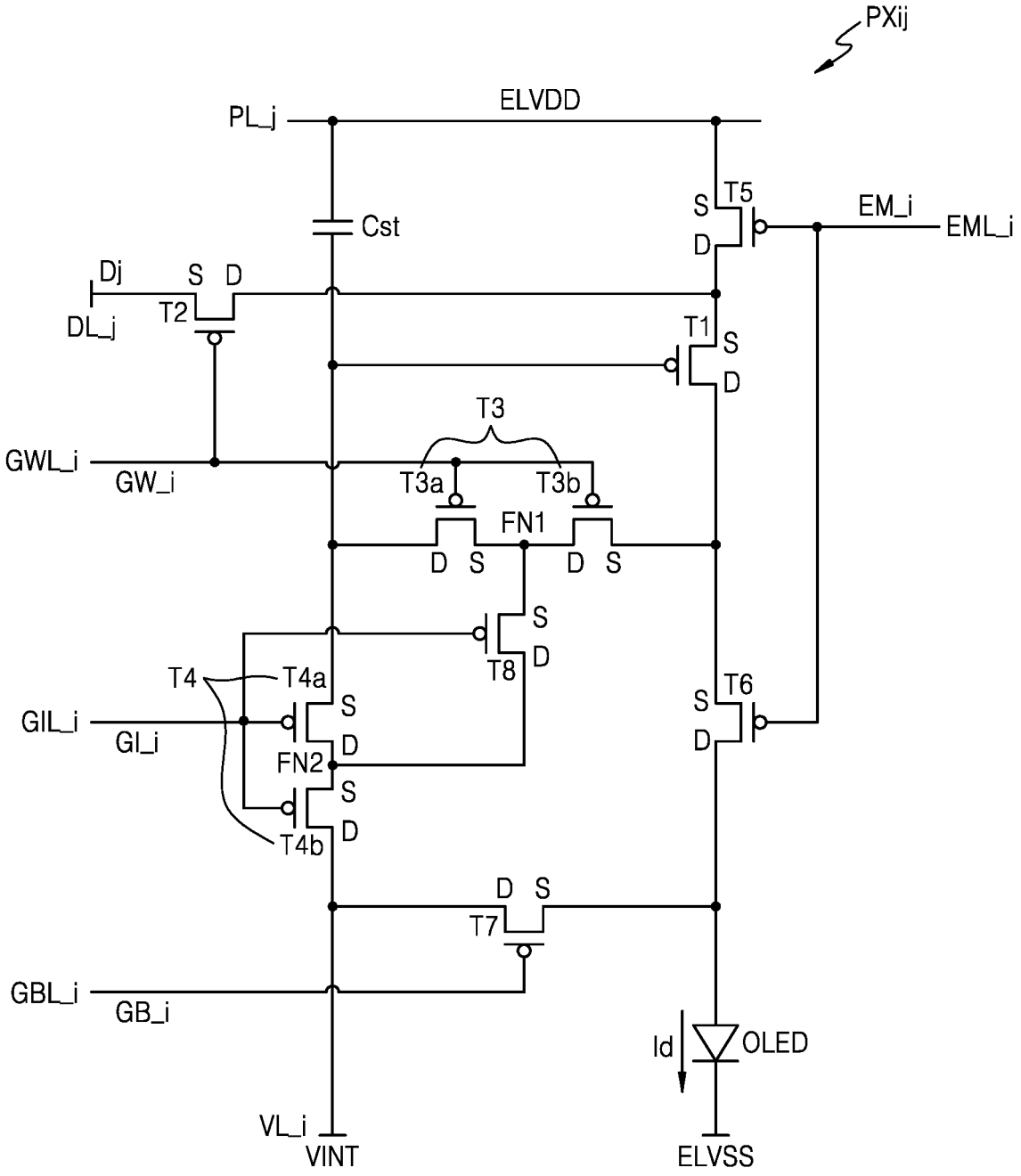
FIG. 2 is a schematic view of a pixel circuit according to an embodiment.

FIG. 2 is a schematic view of a pixel circuit according to an embodiment.

Referring to FIG. 2, the pixel PXij may be electrically connected to first to third scan lines GWL_i, GIL_i, and GBL_i for transmitting the first to third scan signals GW GI_i, and GB_i, respectively, the data line DL_j for transmitting the data voltage Dj, and the emission control line EML_i for transmitting the emission control signal EM_i. The pixel PXij may be electrically connected to the power line PL_j for transmitting the first driving voltage ELVDD and the voltage line VL_i for transmitting the initialization voltage VINT. The pixel PXij may be electrically connected to a common electrode to which the second driving voltage ELVSS may be applied. The pixel PXij may correspond to the pixel PXij of FIG. 1.

The first scan line GWL_i may correspond to the first scan line SL1_*i* of FIG. 1, the second scan line GIL_i may correspond to the second scan line SL2_*i* of FIG. 1, and the third scan line GBL_i may correspond to the second scan line SL2_*i*+1 of FIG.

The pixel PXij may include a light-emitting element OLED, first to eighth TFTs T1 to T8, and a storage capacitor Cst. The light-emitting element OLED may be an organic light-emitting diode having an anode and a cathode. The cathode may be a common electrode to which the second driving voltage ELVSS may be applied. The storage capacitor Cst may include a first electrode and a second electrode.

The first TFT T1 may be a driving transistor in which an amount of a source-drain current may be determined according to a gate-source voltage, and the second to eighth TFTs T2 to T8 may be switching transistors that may be turned on/off according to the gate-source voltage and a gate voltage (e.g., substantially a gate voltage). Each of the second to eighth TFTs T2 to T8 may be provided as one switching transistor or multiple switching transistors that may be simultaneously controlled by the same gate signal and electrically connected in series with each other.

The first TFT T1 may be referred to as a driving TFT, the second TFT T2 may be referred to as a scan TFT, the third TFT T3 may be referred to as a compensation TFT, the fourth TFT T4 may be referred to as a gate initialization TFT, the fifth TFT T5 may be referred to as a first emission control TFT, the sixth TFT T6 may be referred to as a second emission control TFT, the seventh TFT T7 may be referred to as an anode initialization TFT, and the eighth TFT T8 may be referred to as a node connection TFT.

The driving TFT T1 may control an amount of a driving current Id flowing from the power line PL_j to the light-emitting element OLED according to a gate-source voltage. The driving TFT T1 may include a gate electrically connected to the second electrode of the storage capacitor Cst, a source electrically connected to the power line PL_j through the first emission control TFT T5, and a drain electrically connected to the light-emitting element OLED through the second emission control TFT T6.

The driving TFT T1 may output the driving current Id to the light-emitting element OLED. The amount of the driving current Id may be determined based on a gate-source voltage of the driving TFT T1. The gate-source voltage of the driving TFT T1 may correspond to a difference between the gate voltage and the source voltage. For example, the amount of the driving current Id may be determined based on a difference between a gate-source voltage of the driving TFT T1 and a threshold voltage of the driving TFT T1. The light-emitting element OLED may receive the driving current Id from the driving TFT T1 and emit light with a brightness according to the amount of the driving current Id.

The scan TFT T2 may receive the data voltage Dj in response to the first scan signal GW_i. The scan TFT T2 may transmit the data voltage Dj to the source of the driving TFT T1 in response to the first scan signal GW_i. The scan TFT T2 may include a gate electrically connected to the first scan line GWL_i, a source electrically connected to the data line GL_j, and a drain electrically connected to the source of the driving TFT T1.

The storage capacitor Cst may be electrically connected to the gate of the driving TFT T1. The storage capacitor Cst may be electrically connected between the power line PL_j and the gate of the driving TFT T1. The storage capacitor Cst may include a first electrode electrically connected to the power line PL_j and a second electrode electrically connected to the gate of the driving TFT T1. The storage capacitor Cst may store a difference between the first driving voltage ELVDD applied to the power line PL_j and the gate voltage of the driving TFT T1, and may maintain the gate voltage of the driving TFT T1.

The storage capacitor Cst may store (e.g., substantially store) the gate-source voltage of the driving TFT T1 during a light emission period. However, even though the level of the first driving voltage ELVDD is kept constant, a potential of the gate of the driving TFT T1 may change due to a leakage current. For example, as the leakage current flows into the gate of the driving TFT T1, the gate voltage of the driving TFT T1 may gradually increase during the light emission period. Accordingly, the gate-source voltage of the driving TFT T1 may decrease, and the amount of the driving current Id may also decrease. The brightness of the light-emitting element OLED may gradually decrease from a desired brightness.

The compensation TFT T3 may be electrically connected between the gate and the drain of the driving TFT T1, and may electrically connect the gate and the drain of the driving TFT T1 to each other in response to the first scan signal GW_i. The compensation TFT T3 may include a first compensation TFT T3*a* and a second compensation TFT T3*b*, which may be simultaneously controlled by the first scan signal GW_i and electrically connected in series with each other between the gate and the drain of the driving TFT T1.

The first compensation TFT T3*a* may include a gate electrically connected to the first scan line GWL_i, a source electrically connected to a first floating node FN1, and a drain electrically connected to the gate of the driving TFT T1. The second compensation TFT T3*b* may include a gate electrically connected to the first scan line GWL_i, a source electrically connected to the drain of the driving TFT T1, and a drain electrically connected to the first floating node FN1.

In case that the first compensation TFT T3*a* and the second compensation TFT T3*b* are turned on in response to the first scan signal GW_i, the drain and the gate of the driving TFT T1 may be electrically connected to each other, and thus the driving TFT T1 may be diode-connected. The source of the driving TFT T1 receives the data voltage Dj in response to the first scan signal GW_i, and the data voltage Dj may be transmitted to the gate of the driving TFT T1 through the diode-connected driving TFT T1. In case that the gate voltage of the driving TFT T1 becomes equal to the voltage subtracted by the threshold voltage of the driving TFT T1 from the data voltage Dj, the driving TFT T1 may be turned off, and a voltage subtracted by the threshold voltage of the driving TFT T1 from the data voltage Dj may be stored in the storage capacitor Cst.

In case that the first compensation TFT T3*a* and the second compensation TFT T3*b* are turned off in response to the first scan signal GW_i, the first floating node FN1 may float (e.g., substantially float). A potential of the first floating node FN1 may fluctuate by signals therearound, for example, the first scan signal GW_i and the second scan signal GI_i. In particular, the potential of the first floating node FN1 may be coupled to a rising edge of the first scan signal GW_i and increase. Accordingly, a source-drain voltage of the first compensation TFT T3*a* may increase, and a turn-off current of the first compensation TFT T3*a*, for example, the leakage current, may increase.

In case that the first compensation TFT T3*a* and the second compensation TFT T3*b* are turned off, the drain and the gate of the driving TFT T1 may be insulated. However, a weak current may actually flow from the drain to the gate of the driving TFT T1, which may be called a turn-off current. In the case of the storage capacitor Cst, because the turn-off current may cause the gate voltage of the driving TFT T1 to vary, the turn-off may be referred to as a leakage current. In the following description, a current flowing through the turned-off first compensation TFT T3*a* may be referred to as a first leakage current.

The gate initialization TFT T4 may apply the initialization voltage VINT to the gate of the driving TFT T1 in response to the second scan signal GI_i. The gate initialization TFT T4 may include a first gate initialization TFT T4*a* and a second gate initialization TFT T4*b*, which may be simultaneously controlled by the second scan signal GI_i and electrically connected in series with each other between the gate of the driving TFT T1 and the voltage line VL_i.

The first gate initialization TFT T4*a* may include a gate electrically connected to the second scan line GIL_i, a source electrically connected to the gate of the driving TFT T1, and a drain electrically connected to a second floating node FN2. The second gate initialization TFT T4*b* may include a gate electrically connected to the second scan line GIL_i, a source electrically connected to the second floating node FN2, and a drain electrically connected to the voltage line VL_i that transmits the initialization voltage VINT.

In case that the first gate initialization TFT T4*a* and the second gate initialization TFT T4*b* are turned off, the gate of the driving TFT T1 and the voltage line VL_i may be insulated. However, a weak current may actually flow from the gate of the driving TFT T1 to the voltage line VL_i, which may be called a turn-off current. In the following description, a current flowing through the turned-off first gate initialization TFT T4*a* may be referred to as a second leakage current.

The anode initialization TFT T7 may apply the initialization voltage VINT to the anode of the light-emitting element OLED in response to the third scan signal GB_i. The anode initialization TFT T7 may include a gate electrically connected to the third scan line GBL_i, a source electrically connected to the anode of the light-emitting element OLED, and a drain electrically connected to the voltage line VL_i.

The first emission control TFT T5 may connect the power line PL_j and the source of the driving TFT T1 to each other in response to the emission control signal EM_i. The first emission control TFT T5 may include a gate electrically connected to the emission control line EML_i, a source electrically connected to the power line PL_j, and a drain electrically connected to the source of the driving TFT T1.

The second emission control TFT T6 may connect the drain of the driving TFT T1 and the anode of the light-emitting element OLED to each other in response to the emission control signal EM_i. The second emission control TFT T6 may include a gate electrically connected to the emission control line EML_i, a source electrically connected to a drain of the driving TFT T1, and a drain electrically connected to the anode of the light-emitting element OLED.

The node connection TFT T8 may connect the first floating node FN1 and the second floating node FN2 to each other in response to the second scan signal GI_i. The node connection TFT T8 may include a gate electrically connected to the second scan line GIL_i, a source electrically connected to the first floating node FN1, and a drain electrically connected to the second floating node FN2.

The node connection TFT T8 electrically connected between the first floating node FN1 and the second floating node FN2 may reduce an increase amount in the potential of the first floating node FN1 due to coupling with the rising edge of the first scan signal GW_i. Also, the node connection TFT T8 may provide a path for a turn-off current from the first floating node FN1 to the second floating node FN2, thereby lowering the potential of the first floating node FN1 more quickly, and reducing the turn-off current of the first compensation TFT T3*a*.

In the following description, a current flowing through the turned-off node connection TFT T8 may be referred to as a third leakage current.

Figure 3:
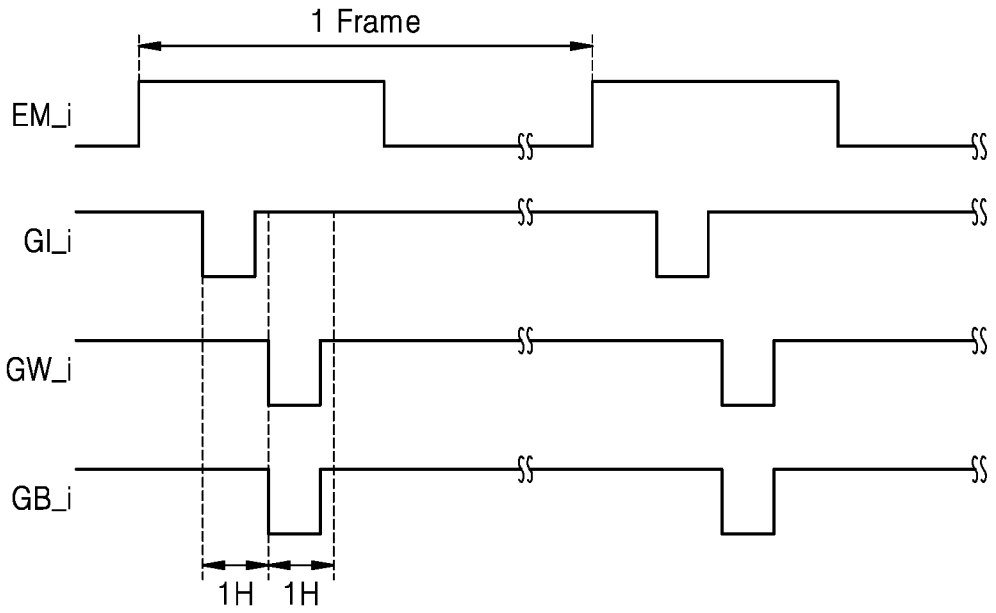
FIG. 3 is a schematic timing diagram of control signals for operating the pixel circuit shown in FIG. 2.

FIG. 3 is a schematic timing diagram of control signals for operating the pixel circuit shown in FIG. 2.

Referring to FIG. 3 along with FIG. 2, in a period in which the emission control signal EM_i has a high level, the first and second emission control TFTs T5 and T6 may be turned off. The period in which the emission control signal EM_i has a high level may be referred to as a non-emission period.

In the non-emission period, the driving TFT T1 may stop outputting the driving current Id, and the light-emitting element OLED may stop emitting light.

The second scan signal GI_i may have a low level first. A period in which the second scan signal GI_i has a pulse voltage of a low level may be referred to as a gate initialization period.

During the gate initialization period, the gate initialization TFT T4 may be turned on, and the initialization voltage VINT may be applied to the gate of the driving TFT T1, for example, the second electrode of the storage capacitor Cst. A difference (ELVDD-VINT) between the first driving voltage ELVDD and the initialization voltage VINT may be stored in the storage capacitor Cst. Also, the node connection TFT T8 may be turned on, the first floating node FN1 and the second floating node FN2 may be electrically connected to each other, and the initialization voltage VINT may be applied to the first floating node FN1 and the second floating node FN2.

After the second scan signal GI_i transitions to a high level again, the first scan signal GW_i may have a low level. A period in which the first scan signal GW_i has a pulse voltage of a low level may be referred to as a data writing period.

During the data writing period, the scan TFT T2 and the compensation TFT T3 may be turned on, and the data voltage Dj may be received at the source of the driving TFT T1. The driving TFT T1 may be diode-connected by the compensation TFT T3 and biased in a forward direction. A voltage of the second electrode of the storage capacitor Cst may increase at the initialization voltage VINT. In case that the gate voltage of the driving TFT T1 becomes equal to a voltage (Dj−|Vth|) reduced by a threshold voltage Vth of the driving TFT T1 from the data voltage Dj, the driving TFT T1 may be turned off and the increase in the gate voltage of the driving TFT T1 may stop. Accordingly, the gate voltage of the driving TFT T1 becomes Dj−|Vth|, and a difference (ELVDD−Dj+|Vth|) between the first driving voltage ELVDD and the gate voltage (Dj−|Vth|) may be stored in the storage capacitor Cst.

Also, after the second scan signal GI_i transitions to a high level again, the third scan signal GB_i may have a low level. A period in which the third scan signal GB_i has a pulse voltage of a low level may be referred to as an anode initialization period.

During the anode initialization period, the anode initialization TFT T7 may be turned on, and the initialization voltage VINT may be applied to the anode of the light-emitting element OLED. By applying the initialization voltage VINT to the anode of the light-emitting element OLED to completely not emit light, a phenomenon in which the light-emitting element OLED weakly emits light in response to a black gray scale in a next frame may be eliminated.

Thereafter, the first scan signal GW_i and the third scan signal GB_i may transition to a high level, the emission control signal EM_i may have a low level. A period in which the emission control signal EM_i has a low level may be referred to as a light emission period.

During the light emission period, the first and second emission control TFTs T5 and T6 may be turned on. The driving TFT T1 outputs the driving current Id having an amount corresponding to a voltage (ELVDD−Dj) obtained by subtracting the threshold voltage (|Vth|) of the driving TFT T1 from the voltage stored in the storage capacitor Cst, for example, the source-gate voltage (ELVDD−Dj+|Vth|) of the driving TFT T1, and the light-emitting element OLED may emit light with a luminance corresponding to the amount of the driving current Id.

The second scan signal GI_i may be synchronized (e.g., substantially synchronized) with a first scan signal GW_i−1 of a previous row. The third scan signal GB_i may be synchronized (e.g., substantially synchronized) with the first scan signal GW_i. According to another example, the third scan signal GB_i may be synchronized (e.g., substantially synchronized) with a first scan signal GW_i+1 of a next row. A difference between a timing at which the second scan signal GI_i has a falling edge and a timing at which the first scan signal GW_i has a falling edge may be one horizontal scanning period 1H.

Figure 4:
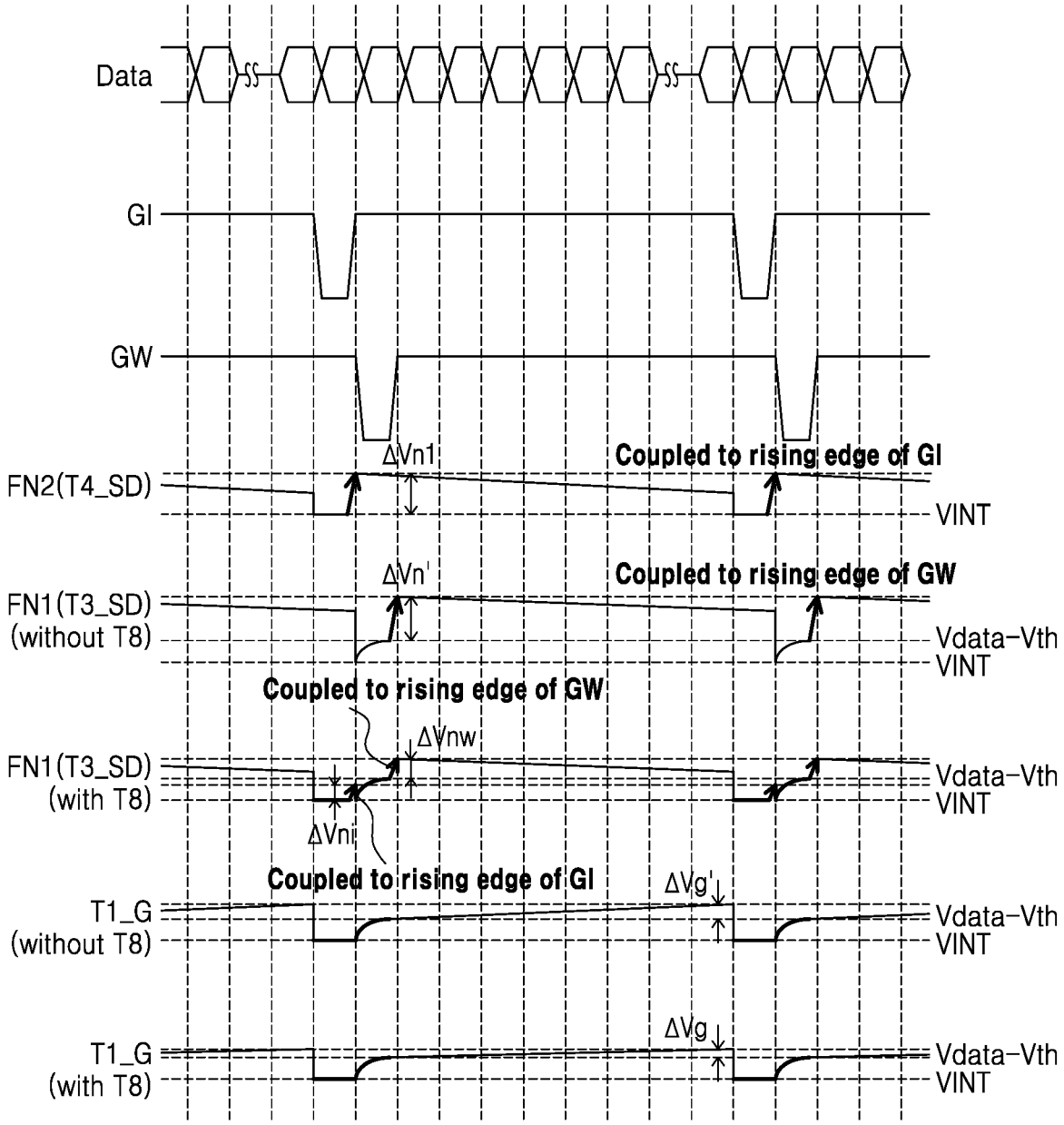
FIG. 4 is a schematic view of voltage waveforms at nodes of the pixel circuit shown in FIG. 2.

FIG. 4 is a schematic view of voltage waveforms of nodes of the pixel circuit shown in FIG. 2.

Referring to FIG. 4 along with FIG. 2, a data signal Data transmitted through a data line DL in FIG. 2, a first scan signal GW transmitted through a first scan line GWL in FIG. 2, and a second scan signal GI transmitted through a second scan line GIL in FIG. 2 are shown.

Also, voltage waveforms of a floating node FN1(T3_SD), a second floating node FN2(T4_SD), and a gate T1_G of the driving TFT T1 are shown. A voltage level of the data signal Data may be denoted as a data voltage Vdata, and an absolute value of the threshold voltage of the driving TFT T1 may be briefly denoted as Vth.

First, the second floating node FN2 will be described. The initialization voltage VINT may be applied to the second floating node FN2 during a period in which the second scan signal GI has a low level.

The first and second gate initialization TFTs T4*a* and T4*b* may be turned off in response to a rising edge of the second scan signal GI and the second floating node FN2 may float. A potential of the second floating node FN2 may be coupled to the rising edge of the second scan signal GI and increase by a first level ΔVn1. The first level ΔVn1 may be changed by a parasitic capacitance between the second floating node FN2 and the first scan line GWL and a parasitic capacitance between the second floating node FN2 and other conductors. Thereafter, the potential of the second floating node FN2, which has increased by the first level ΔVn1, may be changed according to turn-off currents of the first and second gate initialization TFTs T4*a* and T4*b*. For example, as shown in FIG. 4, the potential of the second floating node FN2 may gradually decrease.

As described above, the initialization voltage VINT may also be applied to the gate T1_G of the driving TFT T1 during the period in which the second scan signal GI has a low level. Also, the initialization voltage VINT may also be applied to the first floating node FN1 through the node connection TFT T8. However, as a comparative example, in case that the node connection TFT T8 does not exist, the initialization voltage VINT may not be applied to the first floating node FN1.

Thereafter, during a period in which the first scan signal GW has a low level, the potential of the gate T1_G of the driving TFT T1 may increase from the initialization voltage VINT to a voltage Vdata−Vth obtained by subtracting the threshold voltage Vth from the data voltage Vdata. Because the first and second compensation TFTs T3*a* and T3*b* may be turned on, the potential of the first floating node FN1 also increases to the voltage Vdata−Vth obtained by subtracting the threshold voltage Vth from the data voltage Vdata.

Thereafter, in case that the first scan signal GW has a rising edge, the first and second compensation TFTs T3*a* and T3*b* may be turned off and the first floating node FN1 may float.

The potential of the first floating node FN1 may be coupled to the rising edge of the first scan signal GW and increase by a second level ΔVnw. The second level ΔVnw may be less than the first level ΔVn1. The first floating node FN1 may be capacitively coupled to both the first scan line GWL and the second scan line GIL. Therefore, at a moment that the first scan signal GW has a low level, the first floating node FN1 may also be coupled to the second scan signal GI having a constant level, and thus an increase amount in the potential of the first floating node FN1 may become relatively small.

However, because the first floating node FN1 may be capacitively coupled to both the first scan line GWL and the second scan line GIL, the potential of the first floating node FN1 may also be coupled to the rising edge of the second scan signal GI, and at this timing, may increase by a third level ΔVni. However, the third level ΔVni may be less than the first level ΔVn1 for the same reason as the second level ΔVnw. However, thereafter, in case that the first scan signal GW has a low level, a voltage of the first floating node FN1 becomes equal to the initialization voltage VINT. Also, the potential of the first floating node FN1 may be coupled to the falling edge of the first scan signal GW and decrease. Therefore, in case that the potential of the first floating node FN1 may be coupled to the rising edge of the second scan signal GI and increases by the third level ΔVni, operations of the pixels may not be affected.

As a comparative example, in case that the node connection TFT T8 does not exist, the first floating node FN1 may be capacitively coupled (e.g., substantially capacitively coupled) to the first scan line GWL. The potential of the first floating node FN1 may be coupled to the rising edge of the first scan signal GW and increase by a fourth level ΔVn'. The fourth level ΔVn' may be approximately similar to the first level ΔVn1 and may be greater than the second level ΔVnw as shown in FIG. 4.

Thereafter, the potential of the first floating node FN1, which has increased by the second level ΔVnw, may be changed according to turn-off currents of the first and second compensation TFTs T3*a* and T3*b* and the node connection TFT T8. For example, as shown in FIG. 4, the potential of the first floating node FN1 may gradually decrease.

Since both the second scan signal GI and the first scan signal GW have high levels, the first and second compensation TFTs T3*a* and T3*b*, the first and second gate initialization TFTs T4*a* and T4*b*, and the node connection TFT T8 may all be turned off, but a weak turn-off current may flow therethrough. Accordingly, a voltage of the gate T1_G of the driving TFT T1 may gradually increase.

As a comparative example, in case that the node connection TFT T8 does not exist, the first leakage current flowing from the first floating node FN1 to the gate T1_G of the driving TFT T1 through the turned-off first compensation TFT T3*a* may be considerably large due to a voltage of the first floating node FN1 that has increased by the fourth level ΔVn'. On the other hand, the second leakage current flowing from the gate T1_G of the driving TFT T1 to the first floating node FN1 through the turned-off first gate initialization TFT T4*a* may be relatively small due to a voltage of the second floating node FN2 that has increased by the first level ΔVn1. In the comparative example, the first leakage current flowing through the turned-off first compensation TFT T3*a* may be greater than the second leakage current flowing through the turned-off first gate initialization TFT T4*a*, and a voltage of the gate T1_G of the driving TFT T1 may gradually increase.

According to the embodiment, the node connection TFT T8 may provide a path for the third leakage current. Charges accumulated in the first floating node FN1 may flow out through a turn-off current of the turned-off first compensation TFT T3*a* or through a turn-off current of the turned-off node connection TFT T8. In general, the turn-off currents of the first and second gate initialization TFTs T4*a* and T4*b* may flow from the gate T1_G of the driving TFT T1 to the voltage line VL_i during the light emission period, and thus the voltage of the second floating node FN2 may be lower than the voltage of the gate T1_G of the driving TFT T1. Therefore, a source-drain voltage of the turned-off node connection TFT T8 may be greater than a source-drain voltage of the turned-off first compensation TFT T3*a*, and thus the turn-off current of the node connection TFT T8 may be greater than the turn-off current of the first compensation TFT T3*a*. For example, because at least half of the charges accumulated in the first floating node FN1 may move to the second floating node FN2 through the node connection TFT T8 and to the voltage line VL_i, an amount of charges that move to the gate T1_G of the driving TFT T1 through the first compensation TFT T3*a* may be considerably reduced compared to the comparative example. Accordingly, as shown in FIG. 4, the voltage of the gate T1_G of the driving TFT T1 may gradually increase, but may increase at an increase rate lower than that of the comparative example. Therefore, a change in an amount of a driving current output from the driving TFT T1 may also decrease.

Moreover, compared to the comparative example, an increase amount in the potential of the first floating node FN1 due to coupling with the rising edge of the first scan signal GW may also decrease, and thus an amount of the first leakage current through the turned-off first compensation TFT T3*a* may also decrease compared to the comparative example. Therefore, the change in the amount of the driving current output from the driving TFT T1 may decrease, and a change in the luminance of the light-emitting element OLED may also decrease.

Figure 5:
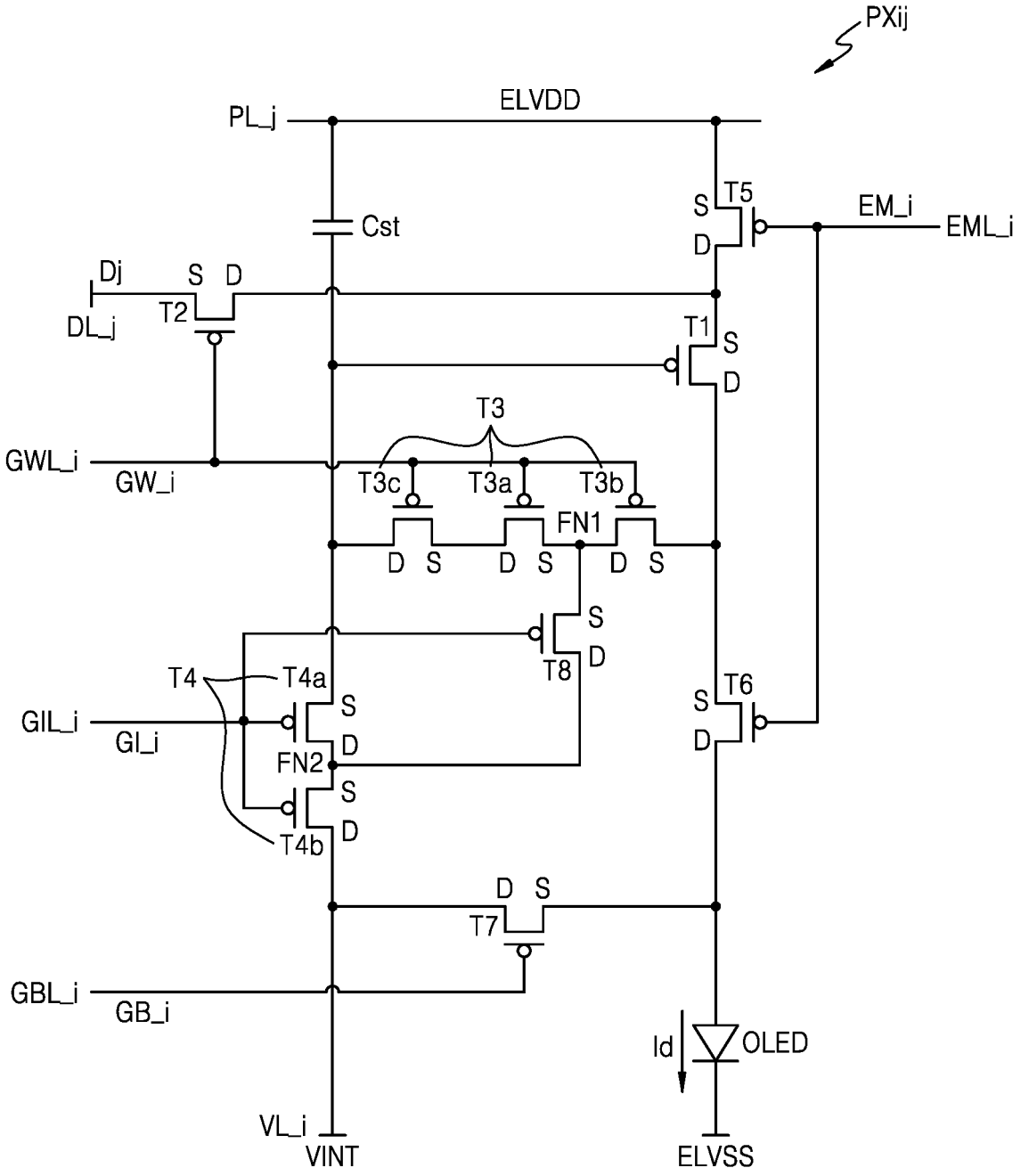
FIG. 5 is a schematic view of a pixel circuit according to another embodiment.

FIG. 5 is a schematic view of a pixel circuit according to another embodiment.

Referring to FIG. 5, the pixel PXij may be substantially the same as the pixel PXij of FIG. 2 except that the compensation TFT T3 may further include a third compensation TFT T3*c*.

The third compensation TFT T3*c* may be included in the compensation TFT T3 along with the first and second compensation TFTs T3*a* and T3*b*. The third compensation TFT T3*c* may be arranged between the gate of the driving TFT T1 and the first compensation TFT T3*a* and may connect the gate of the driving TFT T1 and the drain of the first compensation TFT T3*a* to each other in response to the first scan signal GW_i. The third compensation TFT T3*c* may include a gate electrically connected to the first scan line GWL_i, a source electrically connected to the drain of the first compensation TFT T3*a*, and a drain electrically connected to the gate of the driving TFT T1.

Figure 6:
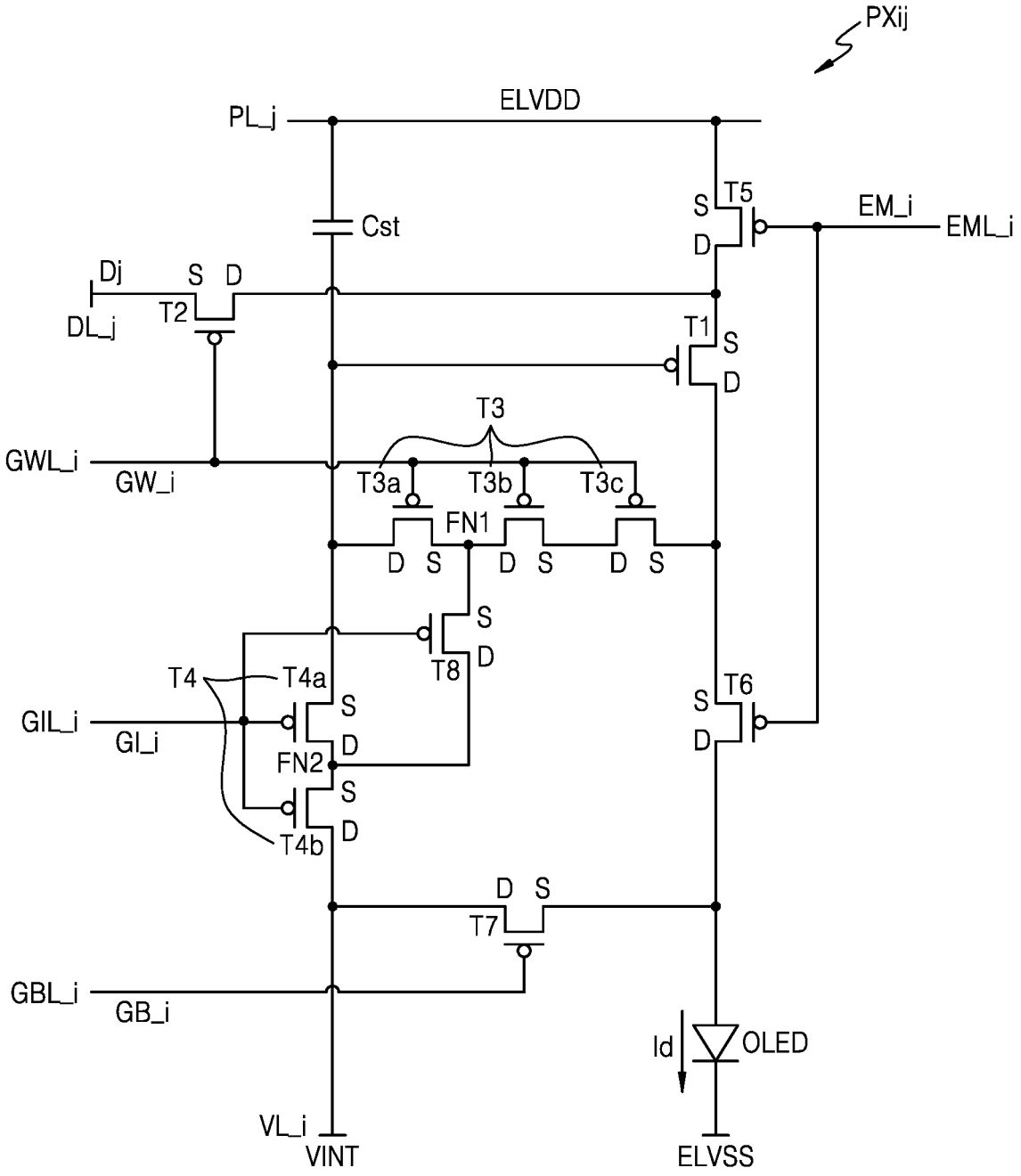
FIG. 6 is a schematic view of a pixel circuit according to another embodiment.

FIG. 6 is a schematic view of a pixel circuit according to another embodiment.

Referring to FIG. 6, the pixel PXij may be substantially the same as the pixel PXij of FIG. 2 except that the compensation TFT T3 further includes a third compensation TFT T3*c*.

The third compensation TFT T3*c* may be included in the compensation TFT T3 along with the first and second compensation TFTs T3*a* and T3*b*. The third compensation TFT T3*c* may be arranged between the second compensation TFT T3*b* and the drain of the driving TFT T1 and may connect the source of the second compensation TFT T3*b* and the drain of the driving TFT T1 to each other in response to the first scan signal GW_i. The third compensation TFT T3*c* may include a gate electrically connected to the first scan line GWL_i, a source electrically connected to the drain of the driving TFT T1, and a drain electrically connected to the source of the second compensation TFT T3*b*.

According to one or more embodiments, a turn-off current of a switching transistor electrically connected to a storage capacitor of a pixel may be reduced. Also, by reducing a leakage current flowing to a gate of a driving transistor, a gate voltage of the driving transistor may be kept constant. Accordingly, the display apparatus according to one or more embodiments may display a more vivid image.

In the specification, although the disclosure is described with respect to the limited embodiments, various embodiments are possible within the scope of the disclosure. Also, although it is not illustrated, equivalent means may be combined to the disclosure as it is. Accordingly, the true protection scope of the disclosure should be defined by the claims below including their equivalents.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope as defined by the following claims, including their equivalents.

What is claimed is:

1. A pixel comprising:

a light-emitting element;

a driving transistor that controls an amount of a driving current flowing to the light-emitting element according to a gate-source voltage;

a storage capacitor electrically connected to a gate of the driving transistor;

a scan transistor that transmits a data voltage to a source of the driving transistor in response to a first scan signal;

first and second compensation transistors that operate in response to the first scan signal, the first and second compensation transistors being electrically connected in series with each other between the gate and a drain of the driving transistor;

first and second gate initialization transistors that operate in response to a second scan signal, the first and second gate initialization transistors being electrically connected in series with each other between a voltage line and the gate of the driving transistor, the voltage line transmitting an initialization voltage; and a node connection transistor that connects a first floating node and a second floating node to each other in response to the second scan signal, the first floating node being between the first and second compensation transistors, and the second floating node being between the first and second gate initialization transistors.

2. The pixel of claim 1, wherein the node connection transistor is turned off in response to a rising edge of the second scan signal, the first and second compensation transistors are turned off in response to a rising edge of the first scan signal, and the first floating node is coupled to the rising edge of the second scan signal at a point of time that the node connection transistor is turned off so that a potential of the first floating node increases, and is coupled to the rising edge of the first scan signal at a point of time that the first and second compensation transistors are turned off so that the potential of the first floating node increases.

3. The pixel of claim 2, wherein the first and second gate initialization transistors are turned off in response to the rising edge of the second scan signal, and the second floating node is coupled to the rising edge of the second scan signal at a point of time that the first and second gate initialization transistors are turned off so that a potential of the second floating node increases.

4. The pixel of claim 3, wherein an increase amount in the potential of the first floating node due to coupling with the rising edge of the first scan signal at the point of time that the first and second compensation transistors are turned off is less than an increase amount in the potential of the second floating node due to coupling with the rising edge of the second scan signal at the point of time that the first and second gate initialization transistors are turned off.

5. The pixel of claim 1, wherein, in case that both the node connection transistor and the first compensation transistor are turned off, a turn-off current flowing from the first floating node to the second floating node through the node connection transistor is greater than a turn-off current flowing from the first floating node to the gate of the driving transistor through the first compensation transistor.

6. The pixel of claim 1, wherein, within one frame period, after the first and second gate initialization transistors and the node connection transistor are turned on in response to the second scan signal having a pulse voltage of a turn-on level, the scan transistor and the first and second compensation transistors are turned on in response to the first scan signal having a pulse voltage of a turn-on level.

7. The pixel of claim 1, further comprising an anode initialization transistor that applies the initialization voltage to an anode of the light-emitting element in response to a third scan signal.

8. The pixel of claim 7, wherein the third scan signal is synchronized with the first scan signal.

9. The pixel of claim 7, further comprising:

a first emission control transistor that connects a power line to the source of the driving transistor in response to an emission control signal, the power line transmitting a driving voltage; and a second emission control transistor that connects the drain of the driving transistor to the anode of the light-emitting element in response to the emission control signal.

10. The pixel of claim 9, wherein the storage capacitor is electrically connected between the power line and the gate of the driving transistor.

11. The pixel of claim 1, further comprising a third compensation transistor that connects the gate of the driving transistor to the first compensation transistor in response to the first scan signal.

12. The pixel of claim 1, further comprising a third compensation transistor that connects the second compensation transistor to the drain of the driving transistor in response to the first scan signal.

13. A pixel electrically connected to first to third scan lines respectively transmitting first to third scan signals, an emission control line transmitting an emission control signal, a data line transmitting a data voltage, a power line transmitting a driving voltage, and a voltage line transmitting an initialization voltage, the pixel comprising:

a light-emitting element including an anode and a cathode;

a storage capacitor including a first electrode and a second electrode, the first electrode being electrically connected to the power line;

a first transistor including a gate electrically connected to the second electrode of the storage capacitor, a source electrically connected to the power line, and a drain;

a second transistor including a gate electrically connected to the first scan line, a source electrically connected to the data line, and a drain electrically connected to the source of the first transistor;

a third transistor including:

a first compensation transistor including a gate electrically connected to the first scan line, a source electrically connected to a first floating node, and a drain electrically connected to the gate of the first transistor; and a second compensation transistor including a gate electrically connected to the first scan line, a source electrically connected to the drain of the first transistor, and a drain electrically connected to the first floating node;

a fourth transistor including;

a first anode initialization transistor including a gate electrically connected to the second scan line, a source electrically connected to the gate of the first transistor, and a drain electrically connected to the second floating node; and a second anode initialization transistor including a gate electrically connected to the second scan line, a source electrically connected to the second floating node, and a drain electrically connected to the voltage line;

a fifth transistor including a gate electrically connected to the emission control line, a source electrically connected to the power line, and a drain electrically connected to the source of the first transistor;

a sixth transistor including a gate electrically connected to the emission control line, a source electrically connected to the drain of the first transistor, and a drain electrically connected to the anode of the light-emitting element;

a seventh transistor including a gate electrically connected to the third scan line, a source electrically connected to the anode of the light-emitting element, and a drain electrically connected to the voltage line; and an eighth transistor including a gate electrically connected to the second scan line, a source electrically connected to the first floating node, and a drain electrically connected to the second floating node.

14. The pixel of claim 13, wherein the eighth transistor is turned off in response to a rising edge of the second scan signal, the first and second compensation transistors are turned off in response to a rising edge of the first scan signal, and the first floating node is coupled to the rising edge of the second scan signal at a point of time that the eighth transistor is turned off so that a potential of the first floating node increases, and is coupled to the rising edge of the first scan signal at a point of time that the first and second compensation transistors are turned off so that the potential of the first floating node increases.

15. The pixel of claim 14, wherein the first and second gate initialization transistors are turned off in response to the rising edge of the second scan signal, and the second floating node is coupled to the rising edge of the second scan signal at a point of time that the first and second gate initialization transistors are turned off so that a potential of the second floating node increases.

16. The pixel of claim 15, wherein an increase amount in the potential of the first floating node due to coupling with the rising edge of the first scan signal at the point of time that the first and second compensation transistors are turned off is less than an increase amount in the potential of the second floating node due to coupling with the rising edge of the second scan signal at the point of time that the first and second gate initialization transistors are turned off.

17. The pixel of claim 13, wherein in case that both the eighth transistor and the first compensation transistor are turned off, a turn-off current flowing from the first floating node to the second floating node through the eighth transistor is greater than a turn-off current flowing from the first floating node to the gate of the first transistor through the first compensation transistor.

18. A display apparatus comprising:

a substrate extending in a first direction and a second direction;

first and second scan lines that respectively transmit first and second scan signals, the first and second scan lines extending in the first direction;

a data line that transmits a data voltage, the data line extending in the second direction;

a power line that transmits a driving voltage;

a voltage line that transmits an initialization voltage, the voltage line extending in the first direction; and pixels arranged on the substrate in the first direction and the second direction, wherein each of the pixels comprises:

a light-emitting element;

a driving transistor that controls an amount of a driving current flowing from the power line to the light-emitting element according to a gate-source voltage;

a storage capacitor electrically connected to a gate of the driving transistor;

a scan transistor that transmits the data voltage to a source of the driving transistor in response to the first scan signal;

first and second compensation transistors that operate in response to the first scan signal, the first and second compensation transistors being electrically connected in series with each other between the gate and a drain of the driving transistor;

first and second gate initialization transistors that operate in response to the second scan signal, the first and second gate initialization transistors being electrically connected in series with each other between the gate of the driving transistor and the voltage line; and a node connection transistor that connects a first floating node to a second floating node in response to the second scan signal, the first floating node being between the first and second compensation transistors, and the second floating node being between the first and second gate initialization transistors.

19. The display apparatus of claim 18, wherein the first floating node is coupled to a rising edge of the second scan signal at a point of time that the node connection transistor is turned off so that a potential of the first floating node increases by a first level, and is coupled to a rising edge of the first scan signal at a point of time that the first and second compensation transistors are turned off so that the potential of the first floating node increases by a second level, and the second floating node is coupled to the rising edge of the second scan signal at a point of time that the first and second gate initialization transistors are turned off so that a potential of the second floating node increases by a third level that is greater than the second level.

20. The display apparatus of claim 18, wherein, in case that both the node connection transistor and the first compensation transistor are turned off, a turn-off current flowing from the first floating node to the second floating node through the node connection transistor is greater than a turn-off current flowing from the first floating node to the gate of the driving transistor through the first compensation transistor.

* * * * *